US009376765B2

(12) United States Patent
Komura et al.

(10) Patent No.: US 9,376,765 B2
(45) Date of Patent: Jun. 28, 2016

(54) CARBON FIBER AND METHOD FOR PRODUCING THE SAME

(75) Inventors: Shinya Komura, Iwakuni (JP); Takanori Miyoshi, Iwakuni (JP); Mitsunao Kakuta, Iwakuni (JP); Eiichi Yasuda, Meguro-ku (JP)

(73) Assignees: TEIJIN LIMITED, Osaka (JP); TOKYO INSTITUTE OF TECHNOLOGY, Tokyo (JP)

( * ) Notice: Subject to any disclaimer, the term of this patent is extended or adjusted under 35 U.S.C. 154(b) by 787 days.

(21) Appl. No.: 12/936,799

(22) PCT Filed: Apr. 6, 2009

(86) PCT No.: PCT/JP2009/057406

§ 371 (c)(1),
(2), (4) Date: Oct. 7, 2010

(87) PCT Pub. No.: WO2009/125857

PCT Pub. Date: Oct. 15, 2009

(65) Prior Publication Data

US 2011/0033705 A1 Feb. 10, 2011

(30) Foreign Application Priority Data

Apr. 8, 2008 (JP) ..... 2008-100029
Apr. 8, 2008 (JP) ..... 2008-100030

(51) Int. Cl.

| | |
|---|---|
| ***D01F 9/12*** | (2006.01) |
| ***D01F 9/14*** | (2006.01) |
| ***D01F 6/44*** | (2006.01) |

(52) U.S. Cl.
CPC .. *D01F 9/14* (2013.01); *D01F 6/44* (2013.01); *Y10T 428/298* (2015.01)

(58) Field of Classification Search
CPC ..... D01F 6/44; D01F 9/14; Y10T 428/298
USPC ..... 423/447.4
See application file for complete search history.

(56) References Cited

U.S. PATENT DOCUMENTS

2006/0012061 A1 1/2006 Hirata et al.

FOREIGN PATENT DOCUMENTS

| | | | | |
|---|---|---|---|---|
| CN | 1957122 | A | | 5/2007 |
| EP | 1 550 747 | A1 | | 7/2005 |
| EP | 1 724 380 | A1 | | 11/2006 |
| JP | 60-27700 | A | | 2/1985 |
| JP | 60-54998 | A | | 3/1985 |
| JP | 2778434 | B | | 5/1998 |
| JP | 2001-73226 | A | | 3/2001 |
| JP | 2004-176236 | A | | 6/2004 |
| JP | 2005-60882 | A | | 3/2005 |
| JP | 2005-264346 | A | | 9/2005 |
| JP | 2005-273038 | A | | 10/2005 |
| JP | 2005-281881 | A | | 10/2005 |
| JP | 2006-63487 | A | | 3/2006 |
| JP | 2006063487 | A | * | 3/2006 |
| JP | 2006-103996 | A | | 4/2006 |
| WO | 2004/031461 | A1 | | 4/2004 |

* cited by examiner

*Primary Examiner* — Elizabeth M Cole
(74) *Attorney, Agent, or Firm* — Sughrue Mion, PLLC

(57) ABSTRACT

A carbon fiber having a lattice spacing (d002) of 0.336 nm to 0.338 nm and a crystallite size (Lc002) of 50 nm to 150 nm as measured and evaluated by X-ray diffraction and a fiber diameter of 10 nm to 500 nm, the carbon fiber having no branched structure.

5 Claims, 2 Drawing Sheets

CARBON FIBER AND METHOD FOR PRODUCING THE SAME

This application is a 371 of PCT/JP2009/057406 filed Apr. 6, 2009.

TECHNICAL FIELD

The present invention relates to a carbon fiber and a method for producing the same. More specifically, the invention relates to an ultrafine carbon fiber having high crystallinity, high electrical conductivity, and no branched structure.

BACKGROUND ART

Carbon fibers have excellent properties including high crystallinity, high electrical conductivity, high strength, high modulus, light weight, etc. In particular, ultrafine carbon fibers (carbon nanofibers) are used as nanofillers for high-performance composite materials. The application thereof is not limited to the conventional use as reinforcing nanofillers for improving mechanical strength. Taking advantage of the high electrical conductivity of a carbon material, they are expected to be applied as electrically conductive resin nanofillers for electrode additive materials for batteries, electrode additive materials for capacitors, electromagnetic shielding materials, and antistatic materials, or as nanofillers for electrostatic coating for resins. Further, taking advantage of the characteristic chemical stability and thermal stability with the fine structure as a carbon material, they are also expected to be used as field electron emission materials for flat displays, etc.

As methods for producing such ultrafine carbon fibers as a high-performance composite material, the following two methods have been reported: 1) a method for the production of carbon fibers using a vapor-phase process (Vapor Grown carbon Fiber; hereinafter referred to as VGCF); and 2) a method for production by melt-spinning a resin composition (mixture).

As production methods using a vapor-phase process, the following methods have been disclosed, for example: a method in which using benzene or a like organic compound as a raw material, ferrocene or a like organotransition metal compound is introduced as a catalyst into a high-temperature reactor with a carrier gas, thereby producing carbon fibers on the base (see, e.g., Patent Document 1); a method in which VGCF is produced in a floating state (see, e.g., Patent Document 2); a method in which carbon fibers are grown on the wall of a reactor (see, e.g., Patent Document 3); etc. Although ultrafine carbon fibers obtained by these methods have high strength and high modulus, there is a problem that each fiber has a number of branches, resulting in poor performance as reinforcing fillers. There also is the problem of high cost due to productivity. Further, production methods using a vapor-phase process are problematic in that purification is required in some fields of application because of the presence of a metal catalyst or carbonaceous impurities in VGCF, and such purification increases the cost.

Meanwhile, as a method for producing carbon fibers by melt-spinning a resin composition (mixture), a method in which ultrafine carbon fibers are produced from composite fibers of phenol resin and polyethylene has been disclosed (see, e.g., Patent Document 4). The method provides ultrafine carbon fibers with a less branched structure. However, there are problems that, for example, because phenol resin is completely amorphous, orientation formation is difficult, and also, because it is a non-graphitizing carbon, strength and modulus cannot be expected from the resulting ultrafine carbon fibers. In addition, there also is a problem that because phenol resin is insolubilized (stabilized) via polyethylene in an acidic solution, the diffusion of the acidic solution in polyethylene is rate-limiting, and insolubilization takes a long period of time, etc.

(Patent Document 1) JP-A-60-27700 (official gazette, pp. 2-3)

(Patent Document 2) JP-A-60-54998 (official gazette, pp. 1-2)

(Patent Document 3) Japanese Patent No. 2778434 (official gazette, pp. 1-2)

(Patent Document 4) JP-A-2001-73226 (official gazette, pp. 3-4)

DISCLOSURE OF THE INVENTION

Problems that the Invention is to Solve

An object of the invention is to solve the problems of the prior art mentioned above, and provide an ultrafine carbon fiber having no branched structure and having high crystallinity and high electrical conductivity. Another object of the invention is to provide a method for producing the carbon fiber.

Means for Solving the Problems

The present inventors conducted intensive research in light of the prior art mentioned above, and eventually accomplished the invention. The configuration of the invention is as follows.

1. A carbon fiber having a lattice spacing (d002) of 0.336 nm to 0.338 nm and a crystallite size (Lc002) of 50 nm to 150 nm as measured and evaluated by X-ray diffraction and a fiber diameter of 10 nm to 500 nm, the carbon fiber having no branched structure.

2. A carbon fiber according to 1 above, having a volume resistivity (ER) of 0.008 Ω·cm to 0.015 Ω·cm as measured using a four-probe electrode unit.

3. A carbon fiber according to 1 above, having a fiber length (L) and a fiber diameter (D) that satisfy the following relational expression (a):

$$30<L/D \quad \text{(a).}$$

4. A method for producing a carbon fiber of any one of 1 to 3 above, comprising:

(1) a step of forming a precursor fiber from a mixture made of 100 parts by mass of a thermoplastic resin and 1 to 150 parts by mass of at least one kind of thermoplastic carbon precursor selected from the group consisting of pitch, polyacrylonitrile, polycarbodiimide, polyimide, polybenzoazole, and aramid;

(2) a step of subjecting the precursor fiber to a stabilization treatment to stabilize the thermoplastic carbon precursor in the precursor fiber, thereby forming a stabilized resin composition;

(3) a step of removing the thermoplastic resin from the stabilized resin composition under reduced pressure, thereby forming a fibrous carbon precursor; and (4) a step of carbonizing or graphitizing the fibrous carbon precursor.

5. A method for producing a carbon fiber according to 4 above, wherein the thermoplastic resin is represented by the following formula (I):

(I)

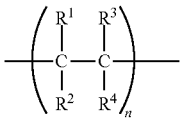

wherein $R^1$, $R^2$, $R^3$, and $R^4$ are each independently selected from the group consisting of a hydrogen atom, a $C_{1-15}$ alkyl group, a $C_{5-10}$ cycloalkyl group, a $C_{6-12}$ aryl group, and a $C_{7-12}$ aralkyl group, and n represents an integer of 20 or more.

6. A method for producing a carbon fiber according to 4 above, wherein the thermoplastic resin has a melt viscosity of 5 to 100 Pa·s as measured at 350° C. and 600 $s^{-1}$.

7. A method for producing a carbon fiber according to 5 or 6 above, wherein the thermoplastic resin is polyethylene.

8. A method for producing a carbon fiber according to 4 above, wherein the thermoplastic carbon precursor is selected from the group consisting of mesophase pitch and polyacrylonitrile.

9. A method for producing a carbon fiber according to 4 above, wherein the thermoplastic resin is polyethylene having a melt viscosity of 5 to 100 Pa·s as measured at 350° C. and 600 $s^{-1}$, and the thermoplastic carbon precursor is mesophase pitch.

Advantage of the Invention

The carbon fibers of the invention have no branched structure, which has been a problem in conventional ultrafine carbon fibers, and thus have excellent properties as reinforcing nanofillers. Further, because of the high electrical conductivity of the highly crystalline carbon material, they have excellent properties as electrically conductive resin nanofillers for electrode additive materials for batteries, electrode additive materials for capacitors, electromagnetic shielding materials, and antistatic materials, or as nanofillers for electrostatic coating for resins. In addition, as compared with carbon fibers obtained from composite fibers of phenol resin and polyethylene, the carbon fibers of the invention provide improved mechanical properties.

BEST MODE FOR CARRYING OUT THE INVENTION

Figure 1:
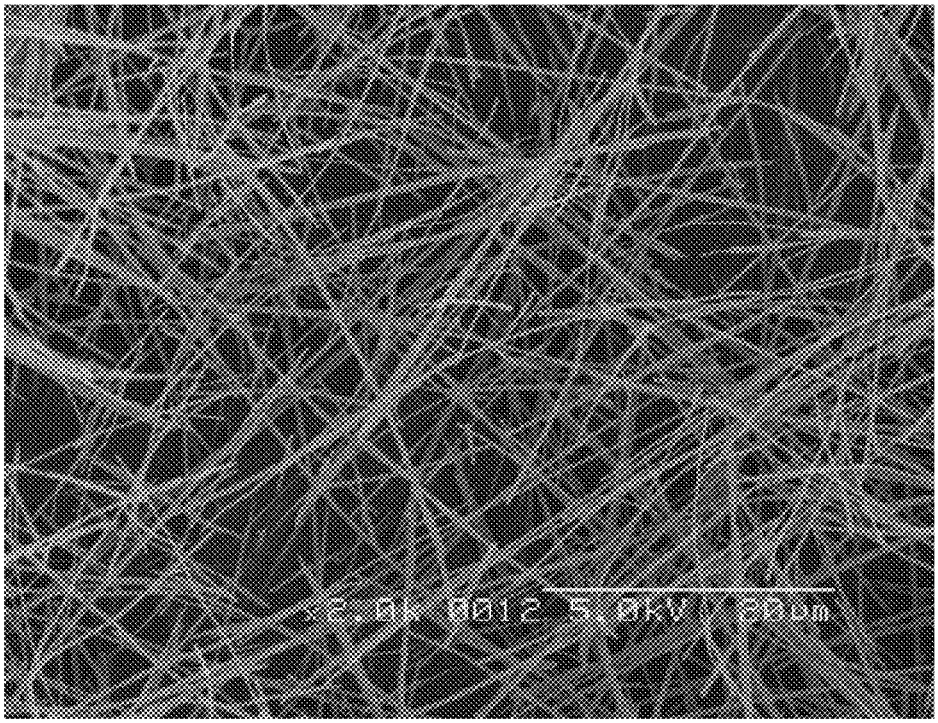
FIG. 1 is a photograph of the surface of a nonwoven fabric obtained by the operation of Example 1, taken by a scanning electron microscope (manufactured by HITACHI, "S-2400") (photographing magnification: ×2,000).
Figure 2:
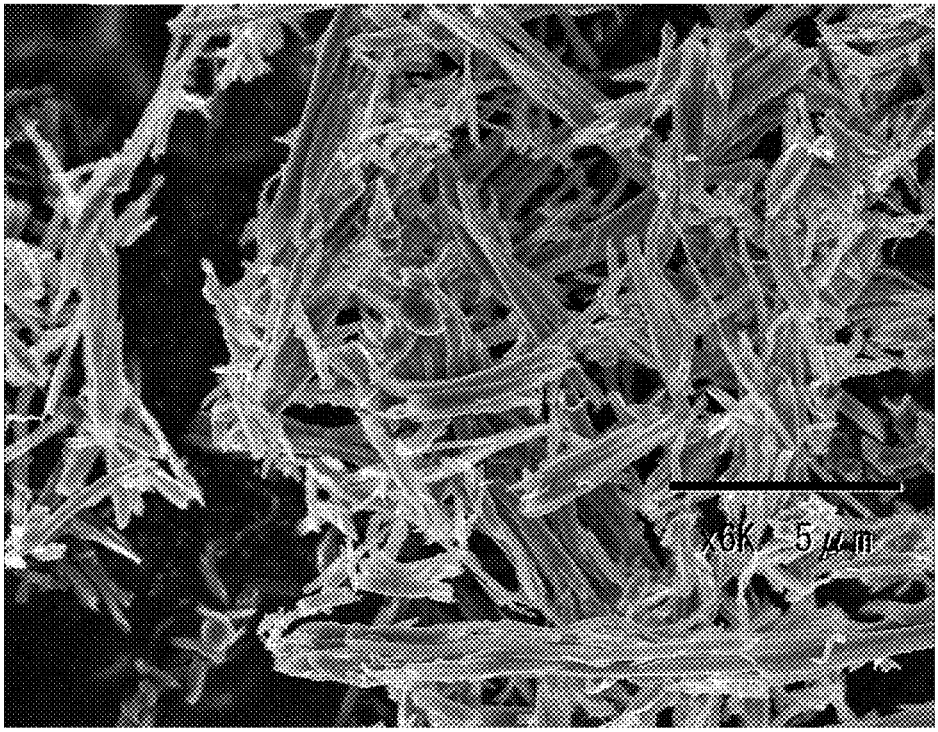
FIG. 2 is a photograph of the surface of a nonwoven fabric obtained by the operation of Comparative Example 2, taken by a scanning electron microscope (manufactured by HITACHI, FE-SEM, S-4800) (photographing magnification: ×6,000).

The invention will be described in detail hereinafter. Unless otherwise noted, ppm and % are by mass.

The invention will be described in detail hereinafter.

The carbon fibers of the invention have a lattice spacing (d002) of 0.336 nm to 0.338 nm and a crystallite size (Lc002) of 50 nm to 150 nm as measured and evaluated by X-ray diffraction, a volume resistivity (ER) of 0.008 Ω·cm to 0.015 Ω·cm as measured using a four-probe electrode unit, and a fiber diameter of 10 nm to 500 nm. Also, the carbon fibers of the invention have no branched structure. The fiber diameter is an average fiber diameter calculated from the fiber diameters of a plurality of carbon fibers, which are measured from an electron microscope photograph of carbon fibers.

When the lattice spacing (d002) is out of the range of 0.336 nm to 0.338 nm or the crystallite size (Lc002) is out of the range of 50 nm to 150 nm, this decreases not only volume resistivity (ER) to go out of the range of 0.008 Ω·cm to 0.015 Ω·cm, resulting in a decrease in electrical conductivity, but also the mechanical properties of the carbon fibers. As carbon fibers with high crystallinity and high electrical conductivity, those having a lattice spacing (d002) of 0.336 nm to 0.3375 nm and a crystallite size (Lc002) of 55 nm to 150 nm are more preferable.

It is necessary that the carbon fibers of the invention have a volume resistivity (ER) of 0.008 Ω·cm to 0.015 Ω·cm. When the volume resistivity is within this range, the carbon fibers of the invention can be provided with electrically conductive properties improved over conventional carbon fibers. They are especially useful as ultrathin carbon fibers, and can be used as electrically conductive resin nanofillers for electrode additive materials for batteries, electrode additive materials for capacitors, electromagnetic shielding materials, and antistatic materials, or as nanofillers for electrostatic coating for resins. When the fiber diameter is more than 500 nm, this significantly decreases the performance as a filler for composite materials with high electrical conductivity. When the fiber diameter is less than 10 nm, the bulk density of the resulting carbon fiber assembly is extremely low, leading to poor handleability.

The ultrafine carbon fibers according to the invention have no branched structure. To have no branched structure herein means that, provided that there are a plurality of carbon fibers extending, they have no granular portions for bonding the carbon fibers to one another, i.e., the core carbon fibers do not have "branch" fibers arising therefrom. However, this does not exclude fibers having a branched structure to the extent where the performance as a filler for high electrical conductivity, which is to be provided by the invention, is maintained.

It is preferable that the fiber length (L) and the fiber diameter (D) meet the following relational expression (a):

$$30 < L/D \text{ (aspect ratio)} \quad \text{(a).}$$

Although there is no particularly preferred value as the upper limit of the L/D (aspect ratio), the theoretically possible maximum is about 200,000.

A preferred method for producing a carbon fiber according to the invention is a method characterized by including:

(1) a step of forming a precursor fiber from a mixture made of 100 parts by mass of a thermoplastic resin and 1 to 150 parts by mass of at least one kind of thermoplastic carbon precursor selected from the group consisting of pitch, polyacrylonitrile, polycarbodiimide, polyimide, polybenzoazole, and aramid;

(2) a step of subjecting the precursor fiber to a stabilization treatment to stabilize the thermoplastic carbon precursor in the precursor fiber, thereby forming a stabilized resin composition;

(3) a step of removing the thermoplastic resin from the stabilized resin composition under reduced pressure, thereby forming a fibrous carbon precursor; and (4) a step of carbonizing or graphitizing the fibrous carbon precursor.

The following provides detailed descriptions of, in order, (i) the thermoplastic resin and (ii) the thermoplastic carbon precursor used in the invention, then (iii) a method for producing a mixture from the thermoplastic resin and the thermoplastic carbon precursor, and (iv) a method for producing a carbon fiber from the mixture.

(i) Thermoplastic Resin

The thermoplastic resin used in the invention needs to be readily removable after the production of stabilized precursor fibers. For this reason, it is preferable to use a thermoplastic resin that is degraded to 15% by mass or less, more preferably 10% by mass or less, still more preferably 5% by mass or less, of the initial mass when maintained in an oxygen or inert gas atmosphere at a temperature of not less than 350° C. and less than 600° C. for 5 hours. It is more preferable to use a thermoplastic resin that is degraded to 10% by mass or less, more preferably 5% by mass or less, of the initial weight when maintained in an oxygen or inert gas atmosphere at a temperature of not less than 450° C. and less than 600° C. for 2 hours.

Preferred examples of such thermoplastic resins include polyolefin, polyacrylate-based polymers such as polymethacrylate and polymethyl methacrylate, polystyrene, polycarbonate, polyarylate, polyester carbonate, polysulfone, polyimide, and polyetherimide. Among these, as a thermoplastic resin that has high gas permeability and is easily pyrolyzable, a polyolefin-based thermoplastic resin represented by the following formula (I) is preferably used, for example:

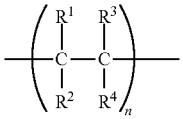

(I)

wherein $R^1$, $R^2$, $R^3$, and $R^4$ are each independently selected from the group consisting of a hydrogen atom, a $C_{1-15}$ alkyl group, a $C_{5-10}$ cycloalkyl group, a $C_{6-12}$ aryl group, and a $C_{7-12}$ aralkyl group, and n represents an integer of 20 or more.

Specific examples of compounds represented by the above formula (I) are copolymers of poly-4-methylpentene-1 or poly-4-methylpentene-1, such as a polymer obtained by the copolymerization of poly-4-methylpentene-1 with a vinyl-based monomer, and polyethylenes. Examples of polyethylenes include homopolymers of ethylene and copolymers of ethylene and α-olefins, such as high-pressure low-density polyethylene, medium-density polyethylene, high-density polyethylene, and linear low-density polyethylene; and copolymers of ethylene and other vinyl-based monomers, such as an ethylene-vinyl acetate copolymer.

Examples of α-olefins to be copolymerized with ethylene include propylene, 1-butene, 1-hexene, and 1-octene. Examples of other vinyl-based monomers include vinyl esters such as vinyl acetate; and (meth)acrylic acid and alkyl esters thereof, such as (meth)acrylic acid, methyl (meth)acrylate, ethyl (meth)acrylate, and n-butyl (meth)acrylate.

The thermoplastic resin used in the production method of the invention preferably has a glass transition temperature of not more than 250° C. in the case where it is amorphous or a crystalline melting point of not more than 300° C. in the case where it is crystalline, because such a thermoplastic resin can be easily melt-kneaded with a thermoplastic carbon precursor.

The thermoplastic resin used in the invention preferably has a melt viscosity of 5 to 100 Pa·s as measured at 350° C. and 600 $s^{-1}$. Although specific reasons are unclear, a melt viscosity of less than 5 Pa·s leads to high volume resistivity, and thus is undesirable. A melt viscosity of more than 100 Pa·s makes it difficult to spin the mixture for producing carbon fibers into precursor fibers, and thus is undesirable. The melt viscosity is more preferably 7 to 100 Pa·s, and still more preferably 5 to 100 Pa·s.

(ii) Thermoplastic Carbon Precursor

As the thermoplastic carbon precursor used in the production method of the invention, it is preferable to use such a thermoplastic carbon precursor that 80% by mass or more of the initial mass remains when maintained in an oxygen gas atmosphere or a halogen gas atmosphere at a temperature of not less than 200° C. and less than 350° C. for 2 to 30 hours, and then maintained in an inert gas atmosphere at a temperature of not less than 350° C. and less than 500° C. for 5 hours. When less than 80% of the initial mass remains under the above conditions, carbon fibers cannot be obtained at a sufficient carbonization rate from such a thermoplastic carbon precursor. This thus is undesirable.

It is more preferable that 85% or more of the initial mass remains under the above conditions. Specific examples of thermoplastic carbon precursors that satisfy the above conditions are rayon, pitch, polyacrylonitrile, poly-α-chloroacrylonitrile, polycarbodiimide, polyimide, polyetherimide, polybenzoazole, and aramids. Among these, pitch, polyacrylonitrile, and polycarbodiimide are preferable, and pitch is more preferable.

Among kinds of pitches, generally, a mesophase pitch, from which high crystallinity, high electrical conductivity, high strength, and high modulus are expected, is preferable. A mesophase pitch herein refers to a compound capable of forming an optically anisotropic phase (liquid crystal phase) in a molten state. Specifically, it is preferable to use a petroleum-based mesophase pitch obtained from petroleum residue oil by a method based on the hydrogenation and heat treatment thereof or by a method based on the hydrogenation, heat treatment, and solvent extraction thereof; a coal-based mesophase pitch obtained from a coal tar pitch by a method based on the hydrogenation and heat treatment thereof or by a method based on the hydrogenation, heat treatment, and solvent extraction thereof; a synthetic liquid crystal pitch obtained, using an aromatic hydrocarbon such as naphthalene, alkyl naphthalene, or anthracene as a raw material, by polycondensation in the presence of a super strong acid (HF, $BF_3$, etc.); or the like. Among these mesophase pitches, synthetic liquid crystal pitches obtained using an aromatic hydrocarbon, such as naphthalene, as a raw material are particularly preferable in terms of the ease of stabilization, carbonization, or graphitization.

(iii) Method for Producing Mixture from Thermoplastic Resin and Thermoplastic Carbon Precursor In the method for producing a carbon fiber according to the invention, a mixture made of the above thermoplastic resin and thermoplastic precursor is prepared and used.

In the preparation of the mixture, the amount of the thermoplastic carbon precursor used is 1 to 150 parts by mass, preferably 5 to 100 parts by mass, per 100 parts by mass of the thermoplastic resin. When the amount of the thermoplastic carbon precursor used is more than 150 parts by mass, precursor fibers having a desired dispersion diameter are not obtained, while when it is less than 1 part by mass, this results in a problem that ultrafine carbon fibers cannot be produced at low cost, etc. Both cases are thus undesirable.

In order to produce carbon fibers having a maximum fiber diameter of less than 2 μm and an average fiber diameter of 10 nm to 500 nm, the mixture used in the production method of the invention is preferably such that the dispersion diameter of the thermoplastic carbon precursor in the thermoplastic resin is 0.01 to 50 μm. The thermoplastic carbon precursor forms an island phase in the mixture, forming a spherical or ellipsoidal shape. The dispersion diameter herein refers to the diameter of a sphere of or to the major-axis diameter of an ellipse of the thermoplastic carbon precursor contained in the mixture.

In the mixture, when the dispersion diameter of the thermoplastic carbon precursor in the thermoplastic resin is out of the range of 0.01 to 50 μm, it may be difficult to produce carbon fibers for high-performance composite materials. The dispersion diameter of the thermoplastic carbon precursor is more preferably 0.01 to 30 μm. Further, it is preferable that after the mixture made of the thermoplastic resin and the thermoplastic carbon precursor is maintained at 300° C. for 3 minutes, the dispersion diameter of the thermoplastic carbon precursor in the thermoplastic resin is 0.01 to 50 μm.

Generally, when a mixture obtained by melt-kneading a thermoplastic resin and a thermoplastic carbon precursor is maintained in a molten state, the thermoplastic carbon precursor agglomerates with time. If the dispersion diameter exceeds 50 μm due to the agglomeration of the thermoplastic carbon precursor, it might be difficult to produce carbon fibers for high-performance composite materials. The agglomeration rate of the thermoplastic carbon precursor varies depending on the kinds of thermoplastic resin and thermoplastic carbon precursor used. It is preferable that a dispersion diameter of 0.01 to 50 μm is maintained for 5 minutes or more at 300° C., and more preferably for 10 minutes or more at 300° C.

As the method for producing the mixture from the thermoplastic resin and the thermoplastic carbon precursor, kneading in a molten state is preferable. The thermoplastic resin and the thermoplastic carbon precursor can be melt-kneaded in a known way as required, examples thereof including a single-screw melt-kneading extruder, a twin-screw melt-kneading extruder, a mixing roll, and a Banbury mixer. Among these, a co-rotating twin-screw melt-kneading extruder is preferable for the purpose of microdispersing the thermoplastic carbon precursor well in the thermoplastic resin.

The melt-kneading temperature is preferably 100° C. to 400° C. When the melt-kneading temperature is less than 100° C., the thermoplastic carbon precursor is not brought into a molten state, making it difficult to form a microdispersion in the thermoplastic resin. This thus is undesirable. Meanwhile, when the melt-kneading temperature is more than 400° C., this promotes the degradation of the thermoplastic resin and the thermoplastic carbon precursor, and thus is also undesirable. The melt-kneading temperature is more preferably 150° C. to 350° C. The melt-kneading time is 0.5 to 20 minutes, and preferably 1 to 15 minutes. When the melt-kneading time is less than 0.5 minutes, this makes it difficult to form a microdispersion of the thermoplastic carbon precursor, and thus is undesirable. Meanwhile, when the melt-kneading time is more than 20 minutes, this significantly decreases the productivity of carbon fibers, and thus is undesirable.

According to the production method of the invention, in the production of the mixture from the thermoplastic resin and the thermoplastic carbon precursor by melt-kneading, it is preferable to perform the melt-kneading in a gas atmosphere with an oxygen gas content of less than 10% by volume. During the melt-kneading, the thermoplastic carbon precursor used in the invention is occasionally denatured due to its reaction with oxygen and becomes insoluble, thereby inhibiting microdispersion in the thermoplastic resin. Therefore, it is preferable to perform melt-kneading while circulating an inert gas so as to reduce the oxygen gas content as much as possible. The oxygen gas content at the time of melt-kneading is more preferably less than 5% by volume, and still more preferably less than 1% by volume. By the above method, a mixture of a thermoplastic resin and a thermoplastic carbon precursor for producing carbon fibers can be produced.

(iv) Method for Producing Carbon Fiber from Mixture

Carbon fibers of the invention can be produced from the mixture made of the thermoplastic resin and the thermoplastic carbon precursor. That is, the carbon fibers of the invention are preferably produced by a method including (1) a step of forming a precursor fiber from a mixture made of a thermoplastic resin and a thermoplastic carbon precursor, (2) a step of subjecting the precursor fiber to a stabilization treatment to stabilize the thermoplastic carbon precursor in the precursor fiber, thereby forming a stabilized precursor fiber, (3) a step of removing the thermoplastic resin from the stabilized precursor fiber, thereby forming a fibrous carbon precursor, and (4) a step of carbonizing or graphitizing the fibrous carbon precursor. The following describes each step in detail.

(1) Step of Forming Precursor Fiber from Mixture made of Thermoplastic Resin and Thermoplastic Carbon Precursor In the production method of the invention, precursor fibers are formed from the mixture obtained by melt-kneading the thermoplastic resin and the thermoplastic carbon precursor. As the method for producing precursor fibers, a method in which a mixture made of the thermoplastic resin and the thermoplastic carbon precursor is melt-spun from a spinneret can be mentioned, for example.

The melting/spinning temperature at the time of melt-spinning is 150° C. to 400° C., preferably 180° C. to 400° C., and more preferably 230° C. to 400° C. The spinning take-up rate is preferably 1 m/min to 2000 m/min, and more preferably 10 m/min to 2000 m/min. When the take-up rate is out of the above range, desired precursor fibers cannot be obtained, and this thus is undesirable.

At the time of the melt-spinning of the mixture obtained by melt-kneading the thermoplastic resin and the thermoplastic carbon precursor from a spinneret, it is preferable that the mixture is fed in a molten state in a pipe and melt-spun from a spinneret. The time from the melt-kneading of the thermoplastic resin and the thermoplastic carbon precursor to the transfer thereof to the spinneret is preferably within 10 minutes.

As an example of an alternative method, precursor fibers may also be formed by melt-blowing the mixture obtained by melt-kneading the thermoplastic resin and the thermoplastic carbon precursor. The melt-blowing conditions are preferably such that the discharge die temperature is 150 to 400° C. and the gas temperature is 150 to 400° C. In melt-blowing, the gas blowing rate influences the fiber diameter of the precursor fibers, and is usually 100 to 2000 m/s, and more preferably 200 to 1000 m/s.

In the production method of the invention, a precursor obtained by forming the mixture made of the thermoplastic resin and the thermoplastic carbon precursor into a film-like shape in an atmosphere of 100° C. to 400° C. (hereinafter sometimes referred to as a precursor film) may also be used in place of the precursor fibers. The film-like shape herein refers to a sheet form having a thickness of 1 μm to 500 μm.

Examples of methods for producing a precursor film from the mixture include a method in which the mixture is sandwiched between two plates, and only one of the plates is rotated or the two plates are rotated in different directions or in the same direction at different rates, thereby forming a sheared film, a method in which a stress is rapidly applied to the mixture using a compression press to form a sheared film, and a method in which a rotary roller is used to form a sheared film.

It is also preferable to stretch the precursor fibers or the precursor film in a molten state or a softened state, thereby further elongating the thermoplastic carbon precursor contained therein. Such a treatment is preferably performed at 100° C. to 400° C., and more preferably at 150° C. to 380° C.

The below-mentioned treatments on precursor fibers can also be applied to a precursor film, except the following step (1') of forming the precursor fibers into a nonwoven fabric and holding the nonwoven fabric by a support substrate.

(1') Step of Forming Precursor Fiber into Nonwoven Fabric having Basis Weight of 100 g/m$^2$ or Less and Supporting the Same by Support Substrate having Heat Resistance to 600° C. or More In the step of the invention, advantageous effects are also provided by forming the precursor fibers into a nonwoven fabric having a basis weight of 100 g/m$^2$ or less, followed by supporting the same by a support substrate having a heat resistance to 600° C. or more. As a result of such a step, in the subsequent stabilization step, the agglomeration of precursor fibers due to a heat treatment can be more suppressed, making it possible to maintain improved breathability between the precursor fibers.

In this step, it is preferable that the nonwoven fabric of the precursor fibers has a basis weight 100 g/m$^2$ or less. When the nonwoven fabric of the precursor fibers has a basis weight of more than 100 g/m$^2$, the heat treatment in the stabilization step allows a greater number of precursor fibers to agglomerate at a portion in contact with the support substrate. As a result, it becomes difficult to maintain the breathability between the precursor fibers in some parts. This thus is undesirable. Meanwhile, in the case of a lower basis weight, although the degree of agglomeration of precursor fibers at a portion in contact with the support substrate can be suppressed, the amount of precursor fibers that can be treated at once is reduced. This thus is undesirable. The basis weight of the precursor fibers is more preferably 10 to 50 g/m$^2$.

The method for producing the nonwoven fabric of the precursor fibers can be suitably selected from known methods for producing nonwoven fabrics, such as a wet method, a dry method, melt-blowing, spunbonding, thermal bonding, chemical bonding, needle punching, hydroentanglement (spunlacing), stitch bonding, etc. A wet method, in which staple fibers are dispersed in a solvent, such as water, and made into paper to thereby form a nonwoven fabric, is particularly preferable. This is because the basis weight (mass per unit area) can be easily adjusted, substances that may have adverse effects in the subsequent steps do not have to be used, etc.

As the support substrate, any support substrate can be used as long as the agglomeration of precursor fibers due to the heat treatment in the stabilization step can be suppressed. However, it is necessary that the support substrate does not undergo deformation or corrosion when heated in the air. With respect to heat resistance, because it is necessary that no deformation occurs at the treatment temperature in the "step of removing the thermoplastic resin from the stabilized resin composition to form a fibrous carbon precursor", a heat resistance to 600° C. or more is required. Examples of such materials include metal materials, such as stainless steel, and ceramics, such as alumina and silica. A metal material is preferable in terms of strength, etc. Although the higher the heat resistance the better, metal materials generally used for industrial devices and machines have a heat resistance to 1200° C. at the highest.

The nonwoven fabric of the precursor fibers can be held by the support substrate in various ways. For example, it is possible to hold a corner of the nonwoven fabric with a pinch cock or the like and hang it like a curtain, to hang the nonwoven fabric on a horizontally disposed pole or string like hanging laundry, to fix the opposite sides of the nonwoven fabric to hold it like a stretcher, or to place the nonwoven fabric on a plate-like object. It is preferable to place the nonwoven fabric of the precursor fibers on a support substrate having a configuration with breathability in the direction vertical to the plane, because effectiveness in maintaining the breathability between the precursor fibers is desired in the stabilization step.

A preferred example of a support substrate having such a configuration is a mesh structure. In the case of using the support substrate having a mesh structure, such as a wire mesh, the mesh size thereof is preferably 0.1 mm to 5 mm. When the mesh size is more than 5 mm, this possibly leads to a greater degree of agglomeration of precursor fibers on the mesh lines due to the heat treatment in the stabilization step, resulting in insufficient stabilization of the thermoplastic carbon precursor. This thus is undesirable. Meanwhile, when the mesh size is less than 0.1 mm, this possibly leads to a decrease in the breathability of the support substrate due to the decrease in the opening ratio of the support substrate, and thus is undesirable.

In the case where the nonwoven fabric of the precursor fibers is placed on the support substrate having such a mesh structure, it is also preferable to stack a plurality of such nonwoven fabrics, and hold them between support substrates. In such a case, the interval between the support substrates is not limited as long as the breathability between the precursor fibers can be maintained, and it is preferable to have an interval of 1 mm or more.

(2) Step of Subjecting Precursor Fiber to Stabilization Treatment to Stabilize Thermoplastic Carbon Precursor in Precursor Fiber to Form Stabilized Resin Composition In the second step of the production method of the invention, the above-obtained precursor fibers are subjected to a stabilization treatment (also referred to as insolubilization treatment) to stabilize the thermoplastic carbon precursor in the precursor fibers, thereby forming a stabilized resin composition. The stabilization of the thermoplastic carbon precursor is a step necessary to obtain carbonized or graphitized carbon fibers. If the next step of removing the thermoplastic resin is performed without performing the stabilization, then this causes problems that the thermoplastic carbon precursor is pyrolyzed or fused, etc.

The method for stabilization may be a known method, such as a gas stream treatment with air, oxygen, ozone, nitrogen dioxide, halogen, or the like, a solution treatment with an aqueous acid solution, etc. In terms of productivity, stabilization in a gas stream is preferable. In terms of ease of handling, the gas component used is preferably air, oxygen, or a mixed gas containing these. Air is particularly preferable in term of cost. The oxygen concentration used is preferably 10 to 100% by volume based on the total gas composition. When the oxygen concentration is less than 10% by volume of the total gas composition, the stabilization of the thermoplastic carbon precursor takes a long period of time. This thus is undesirable.

When respect to the stabilization treatment in a gas stream mentioned above, the treatment temperature is preferably 50 to 350° C., more preferably 60 to 300° C., still more preferably 100 to 300° C., and particularly preferably 200 to 300° C. The stabilization treatment time is preferably 10 to 1200 minutes, more preferably 10 to 600 minutes, still more preferably 30 to 300 minutes, and particularly preferably 60 to 210 minutes.

The above stabilization causes a significant increase in the softening point of the thermoplastic carbon precursor contained in the precursor fibers. For the purpose of obtaining desired ultrafine carbon fibers, the softening point preferably becomes 400° C. or more, and more preferably 500° C. or more. By the above method, the thermoplastic carbon precursor in the precursor fibers is stabilized while maintaining its shape, whereas the thermoplastic resin is softened and melted, losing the fibrous shape before the stabilization treatment; a stabilized resin composition is thus obtained.

(3) Step of Removing Thermoplastic Resin from Stabilized Resin Composition to Form Fibrous Carbon Precursor In the third step of the production method of the invention, the thermoplastic resin contained in the stabilized resin composition is removed by pyrolysis. Specifically, the thermoplastic resin contained in the stabilized resin composition is removed so that only a stabilized fibrous carbon precursor is separated, thereby forming a fibrous carbon precursor. In this step, it is necessary to suppress the pyrolysis of the fibrous carbon precursor as much as possible and also to degrade and remove the thermoplastic resin, so that only the fibrous carbon precursor is separated.

In the production method of the invention, the thermoplastic resin is removed under reduced pressure. By removing the thermoplastic resin under reduced pressure, the removal of the thermoplastic resin and the formation of a fibrous carbon precursor can be performed efficiently. As a result, in the subsequent step of carbonizing or graphitizing the fibrous carbon precursor, carbon fibers with a remarkably reduced degree of fiber fusion can be obtained.

With respect to the pressure of the atmosphere at the time of the removal of the thermoplastic resin, the lower the pressure the better. The pressure is preferably 0 to 50 kPa, but it is difficult to achieve a complete vacuum. Therefore, the pressure is more preferably 0.01 to 30 kPa, still more preferably 0.01 to 10 kPa, and yet more preferably 0.01 to 5 kPa. At the time of the removal of the thermoplastic resin, as long as the above pressure is maintained in the atmosphere, a gas may be introduced. The introduction of a gas allows the thermoplastic resin degradation products to be efficiently removed out of the system. The gas introduced is preferably an inert gas, such as carbon dioxide, nitrogen, or argon, for their advantages in suppressing the fusion caused by the thermal deterioration of the thermoplastic resin.

For the removal of the thermoplastic resin, in addition to the performance under reduced pressure, it is also necessary to perform a heat treatment. The removal is preferably performed at a heat treatment temperature of not less than 350° C. and less than 600° C. The heat treatment time is preferably 0.5 to 10 hours.

(3') Step of Dispersing Fibrous Carbon Precursor

If necessary, it is preferable that the production method of the invention includes a step of dispersing the fibrous carbon precursor obtained by the stabilization treatment. Through such a step, carbon fibers with improved dispersibility can be produced. The method for dispersing the fibrous carbon precursor may be any method as long as the fibrous carbon precursors can be physically separated from one another. Examples of such methods are a method in which the fibrous carbon precursor is added to a solvent, and then dispersed by mechanic stirring or by oscillating the solvent using an ultrasonic wave oscillator or the like, a method in which the fibrous carbon precursor is dispersed using a mill such as a jet mill or a bead mill, etc.

The method in which the fibrous carbon fiber precursor added to a solvent is dispersed by oscillation generated by an ultrasonic wave oscillator or the like is preferable, because this allows the fibrous carbon fiber precursor to be dispersed while maintaining its fibrous shape.

The time of dispersion treatment is not limited, and a treatment for 0.5 to 60 minutes is preferable in terms of productivity. The temperature of dispersion treatment may be room temperature (usually 5 to 40° C. in Japan), and heating or cooling is not necessary. In the case where the solution temperature rises during the dispersion treatment, suitable cooling may be provided.

(4) Step of Carbonizing or Graphitizing Fibrous Carbon Precursor

In the fifth step of the production method of the invention, the fibrous carbon precursor obtained by the removal of the thermoplastic resin is carbonized or graphitized in an inert gas atmosphere, thereby producing carbon fibers. In the production method of the invention, the fibrous carbon precursor is subjected to a high-temperature treatment in an inert gas atmosphere and thereby carbonized or graphitized, giving desired carbon fibers. The obtained carbon fibers preferably have such fiber diameters that the minimum and the maximum are within a range of 0.001 μm (1 nm) to 2 μm. It is more preferable that the average fiber diameter is 0.01 μm to 0.5 μm (10 nm to 500 nm), and still more preferably 0.01 μm to 0.3 μm (10 nm to 300 nm).

The carbonization or graphitization treatment (heat treatment) of the fibrous carbon precursor can be performed by a known method. The inert gas used may be nitrogen, argon, or the like. The treatment temperature is preferably 500° C. to 3500° C., and more preferably 800° C. to 3000° C. In particular, as the graphitization treatment temperature, the temperature is preferably 2000° C. to 3500° C., and more preferably 2600° C. to 3000° C. The treatment time is preferably 0.1 to 24 hours, more preferably 0.2 to 10 hours, and still more preferably 0.5 to 8 hours. The oxygen concentration at the time of carbonization or graphitization is preferably 20 ppm by volume or less, and further 10 ppm by volume or less.

Performing the above method makes it possible to obtain carbon fibers with the degree of fusion of the carbon fibers being extremely low.

EXAMPLES

Hereinafter, the invention will be described in further detail with reference to an Example and Comparative Examples. However, the invention is not limited thereto. The measured values in the examples were calculated by the following methods.

[Dispersed Particle Diameter of Thermoplastic Carbon Precursor in Mixture]

A cooled specimen was cut along an arbitrary plane. The section was observed using a scanning electron microscope (manufactured by HITACHI, S-2400 or S-4800 (FE-SEM)) to determine the particle diameter of a thermoplastic carbon precursor dispersed in islands.

[Carbon Fiber Diameter and Carbon Fiber Fusion Degree]

The dispersed particle diameter of a thermoplastic carbon precursor in a thermoplastic resin, the fiber diameter of carbon fibers, and the degree of fusion of carbon fibers were determined by observation using a scanning electron microscope (manufactured by HITACHI, S-2400 or S-4800 (FE-SEM)) and from a taken photograph. The average fiber diameter of carbon fibers is a value obtained as follows. Twenty points are selected at random from the photograph, the fiber diameters were measured, and all the measurement results (n=20) were averaged to give the average fiber diameter.

[X-Ray Diffraction of Carbon Fiber]

The measurement was made according to the Gakushin method using RINT-2100 manufactured by RIGAKU, and analysis was performed. The lattice spacing (d002) was determined from the 2θ value, and the crystallite size (Lc002) from the half width of the peak.

[Measurement of Carbon Fiber Volume Resistivity (ER)]

Using a powder-resistance measurement system (MCP-PD51) manufactured by DIA INSTRUMENTS, a predetermined amount of test portion was placed into a probe unit with a cylinder 20 mm in diameter×50 mm in height, and the measurement was performed using a four-probe electrode unit under a load of 0.5 kN to 5 kN. From the relationship diagram of volume resistivity (Ω·cm) with a change in pack density (g/cm$^3$), the value of volume resistivity (ER) at the time of the pack density being 0.8 g/cm$^3$ was defined as the volume resistivity (ER) of the specimen.

[Measurement of Resin Melt Viscosity]

Using a viscosity measurement apparatus (ARES) manufactured by TA INSTRUMENTS JAPAN, the melt viscosity was measured with 25-mm parallel plates at a gap spacing of 2 mm.

Example 1

90 parts by mass of high-density polyethylene (manufactured by PRIME POLYMER, HI-ZEX 5000SR; melt viscosity at 350° C. and 600 s$^{-1}$: 14 Pa·s) as a thermoplastic resin and 10 parts of mesophase pitch AR-MPH (manufactured by MITSUBISHI GAS CHEMICAL) as a thermoplastic carbon precursor were melt-kneaded using a co-rotating twin-screw extruder (TEM-26SS manufactured by TOSHIBA MACHINE, barrel temperature: 310° C., in a nitrogen stream) to produce a mixture. In the mixture obtained under these conditions, the dispersion diameter of the thermoplastic carbon precursor in the thermoplastic resin was 0.05 to 2 μm. Further, the mixture was maintained at 300° C. for 10 minutes. As a result, no agglomeration of the thermoplastic carbon precursor was observed, and the dispersion diameter was 0.05 to 2 μm. Subsequently, using a cylinder-type single-hole spinning machine, the mixture was formed into continuous fibers with a fiber diameter of 100 μm at a spinning temperature of 390° C.

Next, staple fibers about 5 cm long were produced from the precursor fibers. On a wire mesh having a mesh size of 1.46 mm and a wire diameter of 0.35 mm, the staple fibers were placed in a basis weight of 30 g/m$^2$ in the form of a nonwoven fabric.

The nonwoven fabric made of the precursor fibers was maintained in a hot air dryer at 215° C. for 3 hours to give a stabilized resin composition. Next, nitrogen replacement was performed in a vacuum gas replacement furnace, and then the pressure was reduced to 1 kPa, followed by heating in such a state, thereby giving a nonwoven fabric made of a fibrous carbon precursor. The heating conditions were as follows. The temperature was raised at a temperature rise rate of 5° C./min to 500° C., and such a temperature was maintained for 60 minutes.

The nonwoven fabric made of the fibrous carbon precursor was added to an ethanol solvent, and vibrated for 30 minutes by an ultrasonic oscillator so as to disperse the fibrous carbon precursor in the solvent. The fibrous carbon precursor dispersed in the solvent was filtered to give a nonwoven fabric having dispersed therein the fibrous carbon precursor.

The nonwoven fabric having dispersed therein the fibrous carbon precursor was heated at 5° C./min to 1000° C. in a vacuum gas replacement furnace while circulating a nitrogen gas, heat-treated at the same temperature for 0.5 hours, and then cooled to room temperature. Further, the nonwoven fabric was placed into a graphite crucible, and, using a ultra-high temperature furnace (manufactured by Kurata Giken Co., Ltd., SCC-U-80/150, soaking part: 80 mm (diameter)×150 mm (height)), the temperature was raised in vacuum from room temperature to 2000° C. at 10° C./min.

After the temperature reached 2000° C., the atmosphere was replaced with argon gas (99.999%) at 0.05 MPa (gage pressure), then the temperature was raised to 3000° C. at a temperature rise rate of 10° C./min, and a heat treatment was performed at 3000° C. for 0.5 hours.

Carbon fibers obtained through such a graphitization treatment had a fiber diameter of 300 to 600 nm (average fiber diameter: 298 nm). Regarding fiber aggregates of a few fibers fused together, there were almost no such fiber aggregates, and the carbon fibers had extremely excellent dispersibility.

As a result of measurement by X-ray diffraction, it was revealed that the lattice spacing (d002) of the obtained carbon fibers was 0.3373 nm that is much smaller than that of the commercial VGCF (manufactured by SHOWA DENKO, carbon nanofibers using a vapor-phase process), 0.3386 nm. In addition, the crystallite size (Lc002) of the carbon fibers was 69 nm that is much larger than that of the commercial VGCF, 30 nm. The obtained carbon fibers thus have extremely high crystallinity. The volume resistivity of the carbon fibers, which shows their electrically conductive properties, was 0.013 Ω·cm that is lower than that of the commercial VGCF, 0.016 Ω·cm. This indicates high electrical conductivity.

Comparative Example 1

A mixture was produced in the same manner as in Example 1, except for using polymethylpentene (TPX RT18 manufactured by MITSUI CHEMICALS; melt viscosity at 350° C. and 600 s$^{-1}$: 0.005 Pa·s) as a thermoplastic resin. The dispersion diameter of the thermoplastic carbon precursor in the thermoplastic resin obtained under these conditions was 0.05 μm to 2 μm. The mixture was maintained at 300° C. for 10 minutes. As a result, no agglomeration of the thermoplastic carbon precursor was observed, and the dispersion diameter was 0.05 μm to 2 μm. Using a cylinder-type single-hole spinning machine, the mixture was spun at 390° C. from a spinneret. As a result, thread breakages often occurred, and it was impossible to obtain stable fibers.

Comparative Example 2

Using a cylinder-type single-hole spinning machine, a mixture obtained in the same manner as in Comparative Example 1 was spun at 350° C. from a spinneret to form precursor fibers. The fiber diameter of the precursor fibers was 200 μm. The precursor fibers were treated in the same manner as in Example 1, except that the step of removing the thermoplastic resin from the stabilized resin composition to form a fibrous carbon precursor was performed in a vacuum gas replacement furnace in a nitrogen stream not under reduced pressure but under normal pressure. A nonwoven fabric having dispersed therein the fibrous carbon precursor was thus produced. The nonwoven fabric made of the fibrous carbon precursor was heat-treated as in Example 1 to give carbon fibers. The obtained carbon fibers had an average fiber diameter of 300 nm and an average fiber length of 10 μm. As a result of measurement by X-ray diffraction, the lattice spacing (d002) was 0.3381 nm, and the crystallite size (Lc002) was 45 nm. The volume resistivity, which shows their electrically conductive properties, was 0.027 Ω·cm.

INDUSTRIAL APPLICABILITY

The carbon fibers according to the invention have excellent characteristics including high crystallinity, high electrical conductivity, high strength, high modulus, light weight, etc., and can thus be used as nanofillers for high-performance composite materials in various applications, such as for electrode additive materials for batteries.

The invention claimed is:

1. A method for producing a carbon fiber having a lattice spacing (d002) of 0.336 nm to 0.338 nm and a crystallite size (Lc002) of 50 nm to 150 nm as measured and evaluated by X-ray diffraction and an average fiber diameter of 10 nm to 500 nm, the carbon fiber having no branched structure, said method comprising:

(1) a step of forming a precursor fiber from a mixture made of 100 parts by mass of a thermoplastic resin having a melt viscosity of 5 to 100 Pa·s as measured at 350° C. and 600 $s^{-1}$ and 1 to 150 parts by mass of at least one kind of thermoplastic carbon precursor selected from the group consisting of pitch, polyacrylonitrile, polycarbodiimide, polyimide, polybenzoazole, and aramid;

(2) a step of subjecting the precursor fiber to a stabilization treatment to stabilize the thermoplastic carbon precursor in the precursor fiber, thereby forming a stabilized resin composition;

(3) a step of removing the thermoplastic resin from the stabilized resin composition under reduced pressure which is 0.01 to 5 kPa, thereby forming a fibrous carbon precursor; and (4) a step of carbonizing or graphitizing the fibrous carbon precursor.

2. A method for producing a carbon fiber according to claim 1, wherein the thermoplastic resin is represented by the following formula (I):

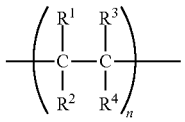

(I)

wherein $R^1$, $R^2$, $R^3$, and $R^4$ are each independently selected from the group consisting of a hydrogen atom, a $C_{1-15}$ alkyl group, a $C_{5-10}$ cycloalkyl group, a $C_{6-12}$ aryl group, and a $C_{7-12}$ aralkyl group, and n represents an integer of 20 or more.

3. A method for producing a carbon fiber according to claim 2, wherein the thermoplastic resin is polyethylene.

4. A method for producing a carbon fiber according to claim 1, wherein the thermoplastic carbon precursor is selected from the group consisting of mesophase pitch and polyacrylonitrile.

5. A method for producing a carbon fiber according to claim 1, wherein the thermoplastic resin is polyethylene having a melt viscosity of 5 to 100 Pa·s as measured at 350° C. and 600 $s^{-1}$, and the thermoplastic carbon precursor is mesophase pitch.

* * * * *